United States Patent [19]

Raufeisen

[11] 4,205,789

[45] Jun. 3, 1980

[54] FUEL INJECTION NOZZLE AND CLAMP ASSEMBLY

[75] Inventor: Robert Raufeisen, Simsbury, Conn.

[73] Assignee: Stanadyne, Inc., Windsor, Conn.

[21] Appl. No.: 877,513

[22] Filed: Feb. 13, 1978

[51] Int. Cl.[2] ..... B05B 1/30

[52] U.S. Cl. ..... 239/533.3

[58] Field of Search ..... 239/533.3–533.12, 239/88–93; 123/32 JV

[56] References Cited

U.S. PATENT DOCUMENTS

| | | | |
|---|---|---|---|
| 2,316,887 | 4/1943 | Pate et al. | 239/533.12 |
| 3,159,349 | 12/1964 | Crocco et al. | 239/533.12 X |

*Primary Examiner*—John J. Love

*Attorney, Agent, or Firm*—Prutzman, Kalb, Chilton & Ailx

[57] ABSTRACT

A fuel injection nozzle and clamp assembly includes an improved nozzle holder having an inlet fitting arrangement which uniformly distributes clamping forces to secure the nozzle to an engine cylinder head without exerting a bending moment on the nozzle. A fuel inlet member extends through a cross bore in the nozzle holder and projects outwardly on opposite sides thereof. A channel-shaped clamp member straddles the nozzle holder body and is provided with notches which receive and engage the projecting ends of the inlet member on opposite sides of the nozzle holder body to secure and orient the nozzle in the cylinder head.

1 Claim, 3 Drawing Figures

FUEL INJECTION NOZZLE AND CLAMP ASSEMBLY

The present invention relates to a fuel injection nozzle and clamp assembly for securing the nozzle to the cylinder head of an internal combustion engine.

In the operation of a fuel injection nozzle of the inwardly opening pressure-operated type, the seizure of the valve may occur if the clamping forces which hold the nozzle in place in the cylinder head of the internal combustion engine are unevenly distributed and apply a bending force to the nozzle body. The tendency of the valve to bind is more frequently encountered in small fuel injection nozzles, which have nozzle bodies with thin walls. Consequently, it is important to provide a mounting arrangement for a fuel injection nozzle in which the clamping forces are uniformly distributed to reduce the possibility of valve binding.

An object of the present invention is to provide an improved fuel injection nozzle and clamp assembly for securing the nozzle to the cylinder head of an internal combustion engine in which the securing forces are uniformly distributed.

Another object is to provide a fuel injection nozzle and holder assembly in which fuel is supplied to the nozzle via an inlet member received in a cross bore formed in the nozzle.

A further object of the invention is to provide an improved fuel injection mounting arrangement including an inlet member received in a cross bore formed in the nozzle and held down by a mounting clamp which engages portions of the inlet member projecting outwardly from opposite sides of the nozzle.

Further, an object of the invention is to provide an improved nozzle and clamp assembly which simplifies the construction and reduces the cost of manufacture.

The accompanying drawing illustrates a preferred embodiment of the invention and, together with the description, serves to explain the principles and operation of the invention.

Figure 1:
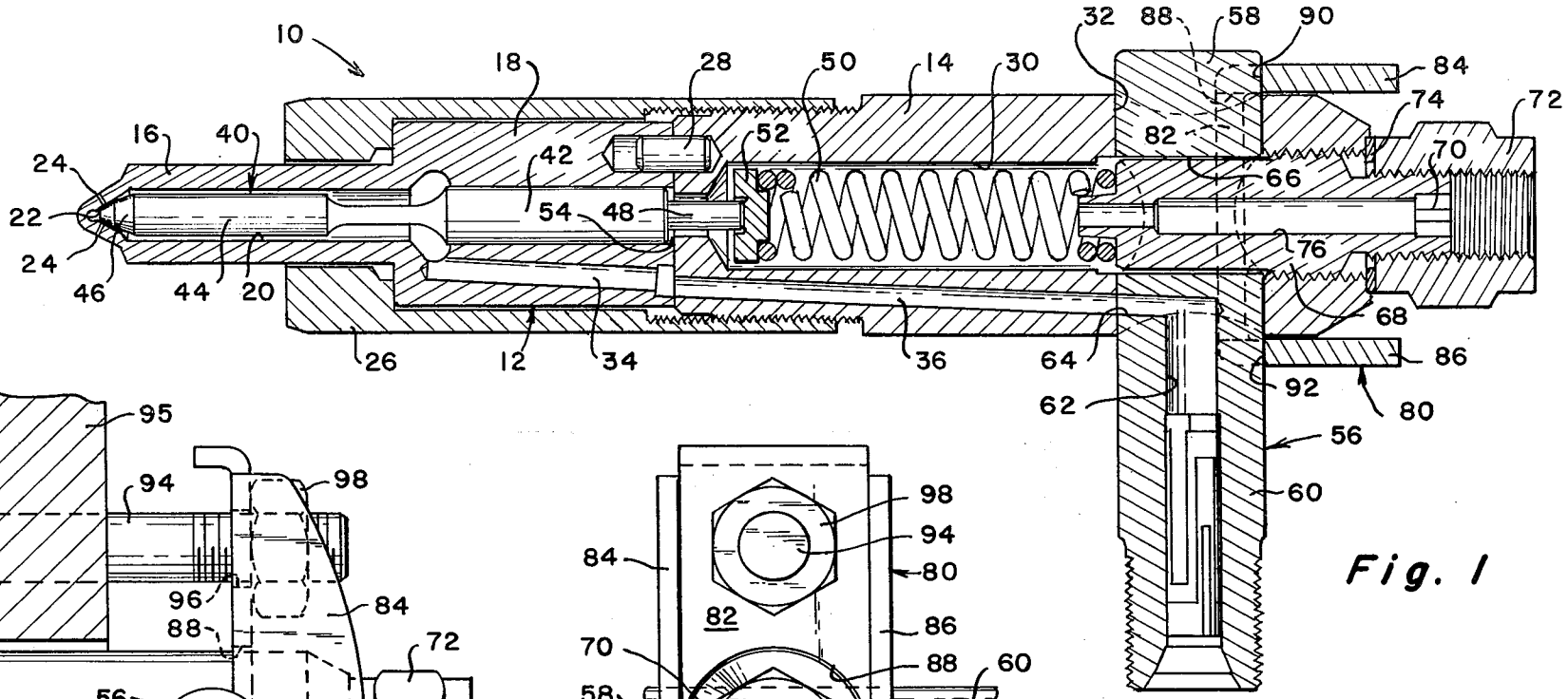
FIG. 1 is a cross-sectional view of a fuel injection nozzle and holder assembly embodying the present invention.
Figure 3:
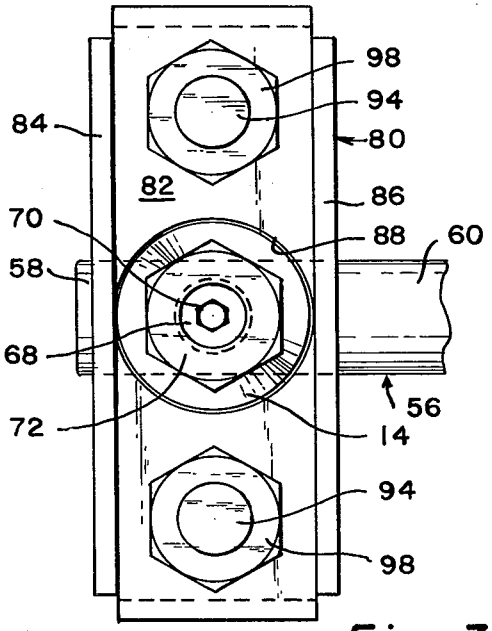
FIG. 3 is an end view of the nozzle and holder assembly.

Referring to FIG. 1, a fuel injection nozzle and holder assembly includes a nozzle, generally 10, comprising a tubular nozzle body 12 and a tubular nozzle holder 14. Nozzle body 12 is a single-piece component which provides a discharge tip 16 at its front end and a valve guide 18 at its rear end. The nozzle body includes a central bore 20 which provides a valve chamber in the nozzle body. Discharge tip 16 includes a conical valve seat 22 and discharge orifices 24 through which fuel is discharged. A retaining member or nut 26 is adapted to hold the rear end of nozzle body 12 against the inner end of nozzle holder 14. A guide pin 28 received in suitable holes formed in the ends of nozzle body 12 and nozzle holder 14 insures proper alignment.

Tubular nozzle holder 14 includes a longitudinal bore 30 in alignment with central bore 20 of the nozzle body. An enlarged cross bore 32 formed in nozzle holder 14 intersects its longitudinal bore 30 adjacent to the outer end of the nozzle holder. In addition, nozzle body 12 and nozzle holder 14 include aligned fuel feed passages 34 and 36, respectively, which provide communication between cross bore 32 and the valve chamber.

A rod-like plunger or valve, generally 40, includes a rear, cylindrical bearing portion 42, slidably mounted in central bore 20 of valve guide 18 and a front, reduced diameter stem portion 44 having a conical tip 46 which cooperatively engages valve seat 22 to control the discharge of fuel from the valve chamber through discharge orifices 24. A projection 48 extends from the rear end of valve 40 into longitudinal bore 30 of nozzle holder 14. A coil spring 50 located within longitudinal bore 30 of the nozzle holder engages a spring seat 52 which, in turn, engages extension 48 to normally bias conical tip 46 of valve 40 into engagement with valve seat 22. A small clearance 54 is provided between valve 40 and nozzle holder 14 to limit the lift of the valve.

A cylindrical fuel inlet member, generally 56, extends through cross bore 32 in nozzle holder 14 and includes a stud portion 58 and an inlet portion 60 projecting outwardly from opposite sides of the nozzle holder. Preferably, inlet member 56 may be copper brazed to nozzle holder 14. Inlet portion 60 includes an axial fuel inlet passage 62 and a radial port 64 to provide communication between the fuel inlet passage and fuel feed passages 34 and 36. Inlet member 56 also includes a cross bore 66 aligned with longitudinal bore 30 in nozzle holder 14. An adjustment screw 68 is threadably mounted within longitudinal bore 30 adjacent to the outer end of nozzle holder 14 and extends through cross bore 66 in inlet member 56 into engagement with coil spring 50. The screw is adjustable via a hex socket 70 formed at its outer end to adjust the compression of coil spring 50. A lock nut 72 is threadably mounted on the outer end of adjustment screw 68 and engageable with the outer end of nozzle holder 14 via a washer 74 to lock the screw in place. A central bore 76 in screw 68 provides a leakage passage for any fuel which enters the spring chamber.

Figure 2:
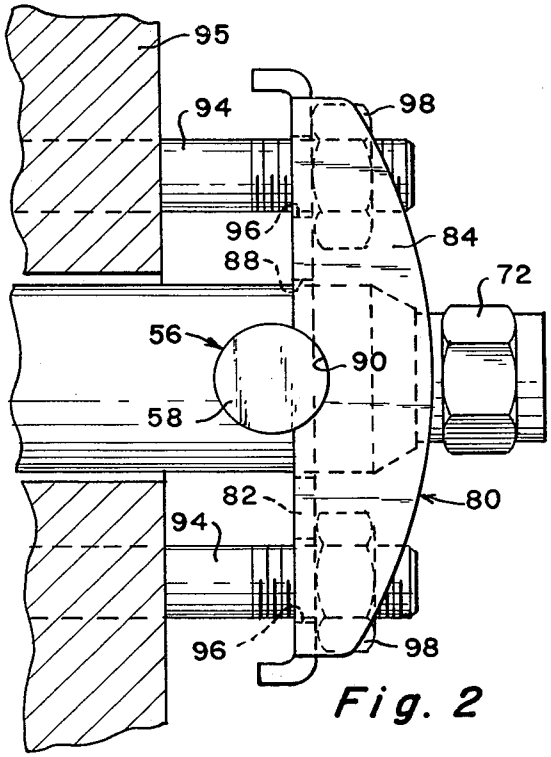
FIG. 2 is a fragmentary top view of the nozzle and holder assembly illustrating a clamp member used to secure the nozzle to a cylinder head.

The fuel injection nozzle and holder assembly includes clamp means straddling the nozzle holder body and engaging the inlet member on opposite sides for securing the assembly to the cylinder head. In the preferred embodiment, an elongated clamp member, generally 80, comprises a flat piece of sheet metal formed into a U-shaped channel having an elongated flat base 82 and a pair of upstanding flanges 84 and 86 extending along opposite longitudinal edges of the flat base. Preferably, the ends of base 82 are turned in the opposite direction from side flanges 84 and 86 to reinforce the base in a lateral direction. A central opening 88 is provided in flat base 82 for receiving tubular nozzle holder 14. Flange 84 includes a concave recess, e.g., a rounded notch 90 (FIGS. 1 and 2), which intersects central opening 88 and engages stud portion 58 of inlet member 56. A similar concave recess or notch 92 (FIG. 1) is provided in flange 86 for engaging inlet portion 60 of the inlet member. A pair of bolts 94 project through holes 96 located adjacent to the opposite ends of flat base 82 of clamp member 80 and are provided with a pair of nuts 98 to hold down the clamp member and secure the nozzle to the cylinder head 95.

By virtue of notches 90 and 92 provided in flanges 84 and 86, respectively, of clamp member 80, the clamp member is allowed to tilt if nuts 98 are tightened unevenly. The clamping arrangement thus provides a uniformly distributed clamping force on inlet member 56 and avoids a bending moment on the nozzle. In addition, the concave recesses in clamp member 80 serve to orient inlet member 56 in a predetermined position to locate discharge orifices 24 in a desired orientation with respect to the engine.

Although rounded notches 90 and 92 of the illustrated embodiment are shown as having the same radius of curvature as round inlet member 56, it will be apparent that notches of other shapes may be employed. For example, the rounded notches may have a radius of curvature less than the round inlet member to more precisely orient the nozzle. Alternatively, the notches may have shapes other than round, e.g., V-shaped or trough-shaped, to engage the projecting portions of the inlet member.

The present invention is not limited to the specific details shown and described, and modifications may be made in the fuel injection nozzle and holder assembly without departing from the principles of invention.

What is claimed is:

1. In a fuel injection nozzle assembly for securing the nozzle to the cylinder head of an internal combustion engine, a nozzle having a valve chamber with a valve seat and a discharge tip at one end thereof, a pressure operated valve slidably disposed in said valve chamber for controlling fuel flow through said discharge tip, and a fuel inlet member providing a fuel inlet passage connecting with said valve chamber, the improvement wherein a transverse bore extends through the nozzle adjacent the end thereof opposite the valve seat, said fuel inlet member extends through said transverse bore to provide ends projecting outwardly from opposite sides of the nozzle, and a U-shaped clamp member having an elongated flat base and side flanges extending along opposite longitudinal edges of said base is provided to engage said oppositely projecting ends to secure the nozzle to the cylinder head, said flat base having a central opening to freely receive said nozzle and each side flange providing a locating notch adjacent said central opening for receiving the corresponding projecting end of said inlet member to orient the nozzle and allow said clamp member to tilt relative to said inlet member.

* * * * *